United States Patent [19]

Alvarez

[11] 4,224,953

[45] Sep. 30, 1980

[54] PIPE

[76] Inventor: Socrates Alvarez, 801 NW. 47 Ave., Apt. W-720, Miami, Fla. 33126

[21] Appl. No.: 936,385

[22] Filed: Aug. 24, 1978

[51] Int. Cl.[2] ..... A24F 1/22; A24F 13/02

[52] U.S. Cl. ..... 131/179; 131/222; 131/223; 131/194

[58] Field of Search ..... 131/194, 196, 202, 205–207, 131/212, 214, 221, 223, 175, 215, 222

[56] References Cited

U.S. PATENT DOCUMENTS

| | | | |
|---|---|---|---|
| 3,312,228 | 4/1967 | Fassbender | 131/205 |
| 3,376,874 | 4/1968 | Kim et al. | 131/207 |
| 3,463,166 | 8/1969 | Bennett et al. | 131/223 X |
| 3,921,645 | 11/1975 | Hagman | 131/207 X |

*Primary Examiner*—Stephen C. Pellegrino
*Attorney, Agent, or Firm*—Jesus Sanchelima

[57] ABSTRACT

A pipe to be used for smoking with a bowl, where the tobacco being smoked is burned, having three cavities or chambers defined therein. One of the chambers is a burning chamber wherein the tobacco to be smoked is burned, beneath the burning chamber is a screen, a control valve that varies the diameter of the passage between the burning chamber and a cooling chamber underneath this valve. A second screen separates the cooling chamber from a third chamber, called the filtering chamber. The filtering medium is the same substance being smoked and it is packed and held inside the filtering chamber with a third screen that is placed at the end of the filtering chamber. The third screen in turn is held in place when the bowl is connected to the stem. Finally, a mouthpiece is connected to the stem. The ends of the bowl piece may be interchanged, thereby providing two choices for the size of the burning chamber to be used depending on the amount of substance to be smoked.

7 Claims, 6 Drawing Figures

PIPE

BACKGROUND OF THE INVENTION

1. Field of Invention

This invention relates to smoking pipes in which the burning rate of the substance and consequently its temperature, may be controlled thereby providing maximum enjoyment to the user. Furthermore, the pipe of this invention may be disassembled and assembled again in a different configuration depending on the use intended.

2. Description of the Prior Art

Many devices for smoking tobacco have been developed and in all these devices the object has been to provide pleasure to the user by controlling the temperature and concentration of the smoke.

In 1920, U.S. Pat. No. 2,336,233 was issued to Ivory in which a pipe with plurality of bowls was claimed. In the preferred embodiment shown in this patent there are two bowls and it is suggested that the intermediate bowl may be filled up with tobacco and closed with a cap or stopper. The other bowl would also be filled up with tobacco and lighted. The smoke would then be drawn from one bowl and circulated through a connecting stem to the other filtering bowl and finally inhaled by the smoker through a second connecting stem.

The present invention differs from Ivory's in that in Ivory's patent the smoke is filtered through the lower part of the filtering bowl whereas in the present invention the entire filtering chamber is in series with the stem and the burning chamber thereby making the smoke circulate through the entire chamber. Also, Ivory's invention does not provide for the regulation of the burning rate of temperature of the substance being smoked.

3. Other Related Patents

Other U.S. patents considered by the applicant as relevant in establishing the prior art include U.S. Pat. Nos. 1,976,496; 2,594,680; 2,662,530; and 3,667,480.

BRIEF DESCRIPTION OF THE INVENTION

It is the object of the present invention to provide a pipe for the smoker in which the air intake may be controlled thereby varying the amount and temperature of smoke inhaled and even being capable of closing the smoke passage completely.

Another object of this invention is to cool down the smoke before it is inhaled by the user.

Another object of this invention is to provide two choices for the size of the burning chamber to be used, according to the amount of tobacco that the user intends to smoke.

Another object of the present invention is to provide storage space for the substance being smoked.

Yet another object of this invention is to provide a filtering chamber filled with the same substance that is being smoked, thereby enriching said substance as the smoke filters therethrough.

Still another object of this pipe is that it can readily be disassembled and easy to clean and use.

Another object of this invention is to provide a pipe that can be assembled in different configurations, and the size of which can be reduced by omitting the stem member from the assembly.

DETAILED DESCRIPTION OF THE PREFERRED EMBODIMENT

Figure 1:
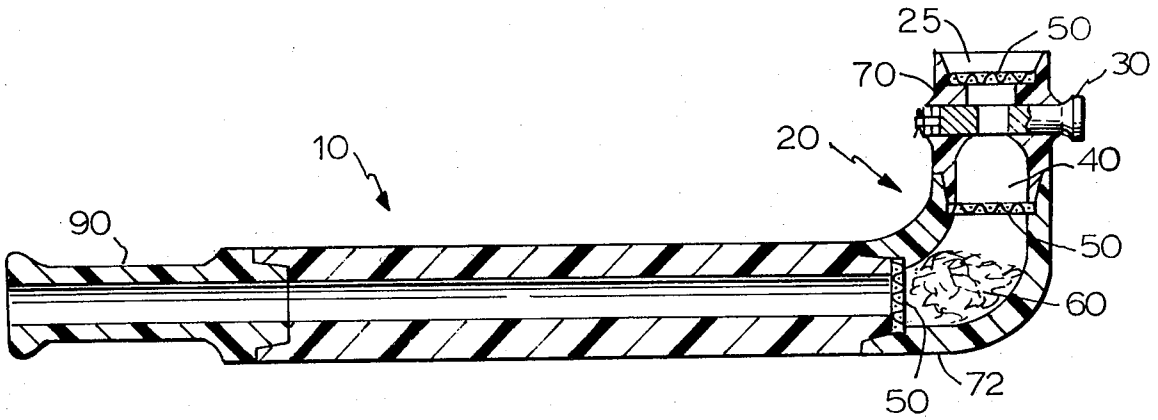
FIG. 1 is a longitudinal cross section of a side view of the pipe.

The pipe 10 of the present invention has three member parts: bowl 20, stem 80 and mouthpiece 90, as shown in FIG. 1. The mouthpiece 90, has a suitable shape for the comfort of the smoker and this shape is not critical in the present invention. The mouthpiece will be threaded or tapered in order to mate with the stem member 80 or with both sides of the bowl member 20, depending on the user's choice. Also the mouthpiece mating termination will be capable of holding a cigarette inserted with contact pressure.

The stem 80 has a tubular shape in the preferred embodiment but it may also be rectangular. The stem's ends 81 have been tapered in order to provide a suitable pressure connection with either the mouthpiece 90 or the bowl 20, but can also be threaded, bayonet type or of any other suitable construction for connecting members together in a substantially airtight fashion.

The bowl member 20 has three chambers or cavities defined therein. The bowl member 20 consists of two separate members: a tubular valve member 70 and a filter chamber member 60. The tubular valve member may consist of short tube with a control valve 30 in the longitudinal center and one cavity formed at each end of the tube. The control valve 30 varies the diameter of the passage between the two cavities defined by the ends of the tube. One of these cavities defines part of cooling chamber 40 when tubular valve member 70 and filter chamber member 60 are connected together. Burning cavity 25 is defined by the walls of the other end of the tubular valve member 35.

Figure 6:
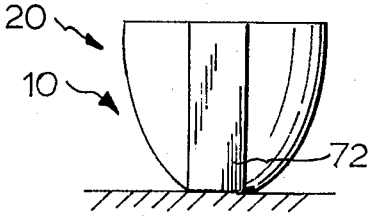
FIG. 6 is a front view of the pipe.

The filter chamber member 60 has a substantially tubular L-shaped with a flat resting surface 72 on its outer periphery where the pipe rests as shown in FIG. 6. The filter chamber member 60 is hollow and defines filter chamber 65 therein. The filter chamber member's ends inner walls are tapered in the preferred embodiment, as shown in FIGS. 1 and 2, and steps 61 are provided with respective screens 50 fitting tightly, and the screens are further secured in place when the filter chamber member 60 is connected to either the stem 80 or the mouthpiece 90 on one end and the tubular valve member 70 of the bowl on the other end.

The screens 50 used in the present invention are made out of brass or any heat resistent material. Their main object is to keep the tobacco being smoked within the proper compartment and at the same time allow the smoke and air to go through.

Figure 2:
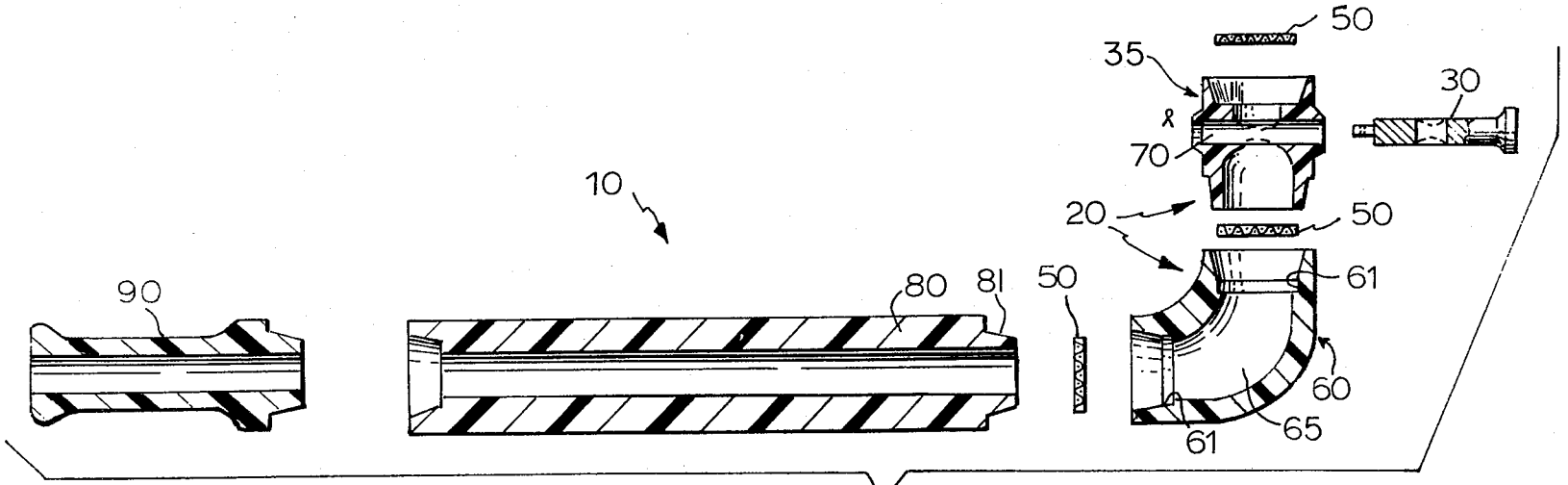
FIG. 2 is a cross section similar to FIG. 1 but showing the pipe's elements disassembled.
Figure 3:
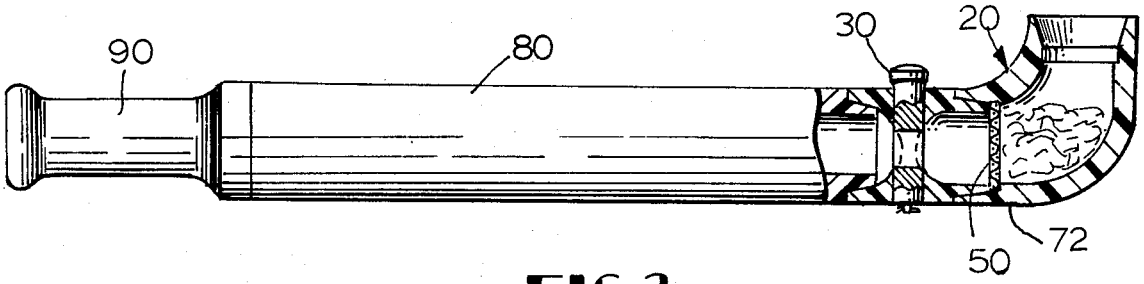
FIG. 3 is a side view with partial cross section of the bowl showing that it has been switched around relative to FIGS. 1 and 2.
Figure 4:
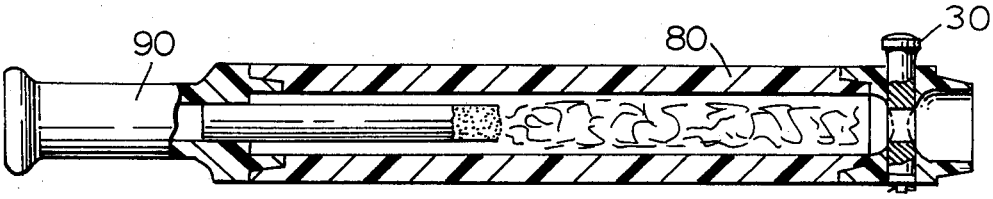
FIG. 4 is a side view of the pipe without the filtering chamber section of the bowl, partially in cross section of the bowl stem.
Figure 5:
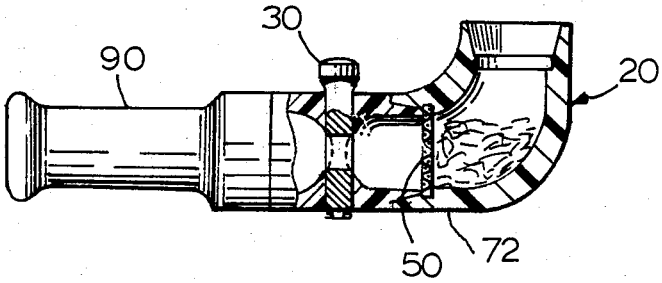
FIG. 5 is a side view of the pipe without the stem member and a partial cross section of the bowl member.

As can be seen in FIG. 2, the different component parts may be easily disassembled and put back together in the configuration selected by the user. As shown in FIG. 3, the bowl 20 may be switched around, depending on whether the user wants to use burning chamber 25 or filter chamber member 60 as the burning cavity, according to the amount and type of tobacco to be used. Also, if a smaller pipe is desired, the stem 80 may be removed and one of the two ends of bowl 20 can be directly connected to the mouth piece 90. (Refer to FIG. 5).

It is to be understood that the forms of the invention herewith shown and described are to be taken as preferred examples of the same, and that various changes in the shape, size and arrangement of parts may be resorted to, without departing from the spirit and scope of the invention.

What I claim is:

1. A pipe for smoking comprising:

a. a cylindrical valve member, having means for varying its inner diameter, and having one cavity defined on each end of said valve member, one of these cavities being a female terminated burning cavity and the other cavity being a male terminated cooling cavity, wherein said burning cavity has a first step located relatively close to the end of said cylindrical valve member;

b. a first screen tightly fit on said first step inside said burning cavity;

c. a longitudinally hollow L-shaped filtering chamber having a female terminated opening on each end and each one of these openings having a step at enough distance away from each of said filtering chamber ends so as to provide the necessary space for being removably secured to said cooling cavity in said valve member;

d. a pair of screens tightly fit on the steps inside said L-shaped filtering chamber;

e. a mouthpiece capable of being removably secured to either said opening in said L-shaped filtering chamber that is not connected to said valve member or to said burning cavity, thereby providing a choice of sizes to the user.

2. A pipe as described in claim 1 further comprising:

g. a hollow stem member having a male termination on one end and a female termination on the other end and said male termination being removably secured either to said opening of said filtering chamber or to said burning cavity and said female termination being removably secured to said mouthpiece, thereby allowing the stem to be between said mouthpiece and said filtering chamber or said burning cavity, at user's choice.

3. A pipe as described in claim 2 wherein said mouthpiece further comprises a round termination on the end that is connected to said stem member and said termination being capable of holding a cigarette by contact pressure.

4. A pipe as described in claim 3 wherein said L-shaped filtering chamber has a resting flat surface along its lower outer periphery.

5. A pipe as described in claim 4 wherein said means for varying the inner diameter of said valve member includes a control valve.

6. A pipe as described in claim 5 wherein said terminations are threaded terminations.

7. A pipe as described in claim 5 wherein said terminations are tapered terminations.

* * * * *